US006499915B1

(12) United States Patent
Tayman

(10) Patent No.: US 6,499,915 B1
(45) Date of Patent: Dec. 31, 2002

(54) PORTABLE PILING EXTENDER APPARATUS

(76) Inventor: Gary Lee Tayman, 15627 Mews Ct., Laurel, MD (US) 20707

( * ) Notice: Subject to any disclaimer, the term of this patent is extended or adjusted under 35 U.S.C. 154(b) by 0 days.

(21) Appl. No.: 09/686,948

(22) Filed: Oct. 12, 2000

Related U.S. Application Data

(60) Provisional application No. 60/159,441, filed on Oct. 14, 1999.

(51) Int. Cl.[7] ..... E02B 3/28

(52) U.S. Cl. ..... 405/212; 405/211; 114/219

(58) Field of Search ..... 405/211, 212, 405/216, 250; 114/215, 216, 219, 230.17; 182/207, 195, 209, 216, 220

(56) References Cited

U.S. PATENT DOCUMENTS

| | | | | | |
|---|---|---|---|---|---|
| 1,691,976 | A | * | 11/1928 | Kramer | 182/209 |
| 2,610,875 | A | * | 9/1952 | Wheelden | 182/209 |
| 3,006,432 | A | * | 10/1961 | Gurley | 182/207 |
| 3,430,598 | A | | 3/1969 | Soderberg | |
| 3,653,463 | A | * | 4/1972 | Neal et al. | 182/195 |
| 3,695,209 | A | | 10/1972 | Giese | |
| 3,842,779 | A | | 10/1974 | Jaynes | |
| 3,858,684 | A | * | 1/1975 | Goings | 182/207 |
| 3,995,565 | A | * | 12/1976 | Kersey | 182/178 |
| 4,086,980 | A | * | 5/1978 | Shortes et al. | 182/151 |
| 4,376,470 | A | * | 3/1983 | Ashton | 182/207 |
| 4,480,576 | A | | 11/1984 | Mills | |
| 4,687,076 | A | * | 8/1987 | Tu | 182/178 |
| 4,764,054 | A | * | 8/1988 | Sutton | 405/216 |
| 4,964,760 | A | * | 10/1990 | Hartman | 405/215 |
| 4,971,167 | A | * | 11/1990 | Winnard | 182/107 |
| 5,007,363 | A | | 4/1991 | James | |
| 5,024,291 | A | * | 6/1991 | Price | 182/207 |
| 5,102,265 | A | * | 4/1992 | Dokmo et al. | 405/216 |
| 5,341,757 | A | | 8/1994 | Diagiacomo | |
| 5,435,667 | A | * | 7/1995 | Strange | 405/216 |
| 5,439,072 | A | * | 8/1995 | Jenkins, Jr. | 182/207 |
| 5,562,364 | A | | 10/1996 | Darder-Alomar | |
| 5,704,448 | A | * | 1/1998 | Jenkins, Jr. | 182/93 |
| 5,727,648 | A | * | 3/1998 | Jenkins, Jr. | 182/93 |
| 5,762,016 | A | * | 6/1998 | Parsons | |
| 6,053,278 | A | * | 4/2000 | Myers | 182/20 |

* cited by examiner

*Primary Examiner*—Robert E. Pezzuto
*Assistant Examiner*—Alexandra Pechhold
(74) *Attorney, Agent, or Firm*—Marvin S. Towsend

(57) ABSTRACT

A portable piling extender apparatus includes a piling attachment unit which includes a piling fence portion. A manually operable strap assembly is connected to the piling fence portion. A riser fence unit is provided, and connector tubes connect the riser fence unit to the piling fence portion. Alignment locks lock the riser fence unit to the piling fence portion. Preferably, the piling fence portion includes a pair of piling fence tubes, and a pair of first transverse struts are connected between the piling fence tubes. The riser fence unit includes riser fence tubes, and second transverse struts are connected between the riser fence tubes. The front faces of the piling fence tubes and the front faces of the riser fence tubes are substantially coplanar when the riser fence tubes are connected to the piling fence tubes. The apparatus is connected to a piling to raise its effective height to prevent the rubrail of a boat from riding over the top of a piling which may result in the piling damaging the hull of the boat.

24 Claims, 3 Drawing Sheets

PORTABLE PILING EXTENDER APPARATUS

CROSS-REFERENCE TO RELATED APPLICATION

This application claims priority based upon my Provisional Application Serial No. 60/159,441, filed Oct. 14, 1999 now abandoned.

BACKGROUND OF THE INVENTION

1. Field of the Invention

The present invention relates generally to devices interposed between boats and pilings to which the boats are moored. More particularly, the present invention relates to devices especially adapted to prevent boats from being damaged by the pilings as the boats rise and fall in the water.

2. Description of the Prior Art

When a boat is in the water and moored to a pile or piling, there is a risk that the boat may be damaged by the piling as the boat rises and fall in the water. The risk of damage is especially acute in times of rapidly rising and falling water, such as occurs in storms. Throughout the years, a number of innovations have been developed relating to devices which help prevent a boat from being damaged by pilings during times of rising and falling water, and the following patents are representative of some of those innovations: U.S. Pat. No. 3,430,598 of Soderberg, U.S. Pat. No. 3,695,209 of Giese, U.S. Pat. No. 3,842,779 of Jaynes, U.S. Pat. No. 4,480,576 of Mills, and U.S. Pat. No. 5,341,757 of Diagiacomo.

More specifically, U.S. Pat. No. 3,430,598 of Soderberg discloses a device with which a boat can be moored and float up and down in water. With the device, a pair of poles that are driven into earth under a body of water are fitted with floats that ride up and down on the poles as the boat rises and falls. in the water. The boat is moored to the floats. Driving poles into the earth under a body of water requires considerable effort. In this respect, it would be desirable if a device were provided that prevents a boat from being damaged during times of rising and falling water which does not require driving poles into the earth under a body of water.

U.S. Pat. No. 3,695,209 of Giese discloses a device with which a boat can be moored and float up and down in water. With the device, an upward extender is attached to the side of a dock, and a descending tube is attached to the upward extender. The boat is moored to the descending tube, and the boat rises and falls in the water with its mooring roped sliding up and down on the descending tube. With the Giese device, each dock must be equipped with a device. As a practical matter, most docks are not actually equipped with such a device. In terms of practicality, it would be desirable if a device that prevents a boat from being damaged during times of rising and falling water can be portable and carried along in the boat so that the device would be readily available each time the boat is ready to dock.

U.S. Pat. No. 3,842,779 of Jaynes discloses a device with which a boat can be moored and float up and down in water. With the device, a C-shaped upward/downward extender is attached with U-shaped clamps to the side of a dock, and a cable is attached between opposite ends of the C-shaped upward/downward extender. A sleeve slides on the cable, and a boat is moored to the sleeve. Portions of the C-shaped upward/downward extender can be disassembled when not in use. When the boat rises and falls in the water, the sleeve rises and falls along the cable. With this device, a sleeve is constantly riding up and down on a cable. There is a degree of frictional contact between the sleeve and the cable, and each time the sleeve rides on the cable, the frictional contact causes wear and tear on the sleeve and the cable. To avoid such wear and tear, it would be desirable if a device were provided that prevents a boat from being damaged during times of rising and falling water which does not use a sleeve that rides up and down on a cable.

U.S. Pat. No. 4,480,576 of Mills discloses a device with which a boat can be moored and float up and down in water. With the device, a tripod is attached to the top of a dock, and a descending post is attached to the tripod. A carriage is supported on the descending post, and a boat is moored to the carriage. When the boat rises and falls in the water, the carriage rises and falls along the descending post. With this device, a carriage is constantly riding up and down on a descending post. There is a degree of frictional wear and tear between moving parts within the carriage each time the carriage rides on the descending post. To avoid such wear and tear, it would be desirable if a device were provided that prevents a boat from being damaged during times of rising and falling water which does not employ a carriage which has internal moving parts.

U.S. Pat. No. 5,341,757 of Diagiacomo discloses a piling extender in FIGS. 11 and 12. The piling extender appears to be received telescopically on the piling. The piling extender is not strapped onto the piling. The piling extender is a one-piece structure that is not collapsible. A top bracket is located at the top of the piling extender, and a bottom bracket is attached to a portion of the piling below the level of the dock. Cables extend between the top bracket and the bottom bracket. A pulley assembly is carried by the cable, and a boat is moored to the pulley assembly. When the boat rises and falls in the water, the pulley assembly rises and falls along the cable. The pulleys in the pulley assembly have moving parts as the pulley assembly rises and falls along the cable as the boat rises and falls in the water. As discussed above in relation to U.S. Pat. No. 4,480,576, there is frictional wear and tear between moving parts as the parts move as the boat rises and falls in the water. To avoid such wear and tear, it would be desirable if a device were provided that prevents a boat from being damaged during times of rising and falling water which does not employ a pulley assembly which has internal moving parts.

In addition, it is noted that U.S. Pat. No. 5,341,757 employs a piling extender that fits onto the top of a piling in a substantially permanent way. In this respect, that piling extender is not portable. Moreover, that piling extender is not collapsible, and as such, is not suitable for being carried on a boat for use on docks and pilings wherever the boat docks.

In addition to the patents discussed above, the following patents may also be of interest: U.S. Pat. No. 5,007,363 of James and U.S. Pat. No. 5,562,364 of Darder-Alomar.

More specifically, U.S. Pat. No. 5,007,363 of James discloses a mooring fender that straps onto a portion of a piling that extends above a dock. The fender does not extend above the top of the piling. The boat is not moored to the fender.

U.S. Pat. No. 5,562,364 of Darder-Alomar discloses a protective fender that straps onto a portion of a piling that extends above and below a dock. The fender does not extend above the top of the piling. The boat is not moored to the fender.

With respect to the patents discussed above, it is noted that none of those patents discloses a piling extender which is collapsible for portability and storage. In this respect, these are key features of the present invention.

Still other features would be desirable in a portable piling extender apparatus. For example, for a portable piling extender apparatus, it would be desirable if the apparatus were easily attached to and removed from a piling. In addition, for securing the straps to a piling, it would be desirable if strap buckles or clamps are provided for strongly securing the straps to the piling. In addition, when a piling extender portion is attached to a unit is attached to the piling, it would be desirable if the piling extender portion and the piling-attached unit were locked together.

A piling, in a horizontal cross-sectional plane, is generally round in cross-section. On the other hand, in a horizontal cross-sectional plane, the rubrail of a boat is generally linear in cross-section. With this in mind, to be more compatible with the linear horizontal cross-section of the rubrail, it would be desirable if the horizontal cross-section of a piling extender provides a generally linear contact region with the rubrail of the boat.

Thus, while the foregoing body of prior art indicates it to be well known to use a device that prevents a boat from being damaged during times of rising and falling water, the prior art described above does not teach or suggest a portable piling extender apparatus which has the following combination of desirable features: (1) does not require driving poles into the earth under a body of water; (2) is portable and is carried along in a boat so that the apparatus is readily available each time the boat is ready to dock; (3) does not use a sleeve that rides up and down on a cable; (4) does not employ a carriage which has internal moving parts; (5) is easily attached to and removed from a piling; (6) includes strap buckles or clamps for strongly securing attachment straps to a piling; (7) includes a piling extender portion and a piling-attached unit which are locked together; and (8) has a generally linear horizontal cross-section for contacting a rubrail of a boat which also has a linear horizontal cross-section. The foregoing desired characteristics are provided by the unique portable piling extender apparatus of the present invention as will be made apparent from the following description thereof. Other-advantages of the present invention over the prior art also will be rendered evident.

SUMMARY OF THE INVENTION

To achieve the foregoing and other advantages, the present invention, briefly described, provides a portable piling extender apparatus which includes a piling attachment unit which includes a piling fence portion. A manually operable strap assembly is connected to the piling fence portion. A riser fence unit is provided, and alignment connectors are provided for connecting the riser fence unit to the piling fence portion. Alignment locks are provided for locking the riser fence unit to the piling fence portion.

Preferably, the piling fence portion includes a pair of piling fence tubes, and a pair of first transverse struts are connected between the piling fence tubes. The front faces of the piling fence tubes are substantially coplanar.

The strap assembly includes a first strap unit and second strap units. The first strap unit includes a first strap member, and a first strap lock is connected to the first strap member. The second strap units include second strap members, and second strap locks are connected to the second strap members. The second strap locks include strap tensioning ratcheted locks, and buckle ends are received in the strap tensioning ratcheted locks.

The piling fence tubes include first strap reception channels and second strap reception channels. The first strap member is threaded through the first strap reception channels, and second strap members are threaded through the second strap reception channels.

The riser fence unit includes riser fence tubes, and second transverse struts are connected between the riser fence tubes. The front faces of the riser fence tubes are substantially coplanar. In this respect, the front faces of the piling fence tubes and the front faces of the riser fence tubes are substantially coplanar when the riser fence tubes are connected to the piling fence tubes. The front faces of the piling fence tubes and the front faces of the riser fence tubes further include fence cushions.

The riser fence unit further includes riser tube caps located on top of the riser fence tubes. The riser tube caps have rounded tops. The riser tube caps are made from cushiony material. The riser fence tubes are registrable with the piling fence tubes. The alignment connectors can be in a form of connector tubes. The alignment locks can include flexible tethers connected to either the first transverse struts or the second transverse struts. Lock pins are connected to the flexible tethers. First pin reception channels are located in the piling fence tubes and the riser fence tubes, and second pin reception channels are located in the connector tubes. The piling fence tubes includes alignment connector tube stops located inside the piling fence tubes.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is, therefore, an object of the present invention is to provide a portable piling extender apparatus which does not require driving poles into the earth under a body of water.

Still another object of the present invention is to provide a piling extender apparatus that is portable and is carried along in a boat so that the apparatus is readily available each time the boat is ready to dock.

Yet another object of the present invention is to provide a portable piling extender apparatus which does not use a sleeve that rides up and down on a cable.

Even another object of the present invention is to provide a portable piling extender apparatus that does not employ a carriage which has internal moving parts.

Yet another object of the present invention is to provide a portable piling extender apparatus that is easily attached to and removed from a piling.

Still another object of the present invention is to provide a portable piling extender apparatus which includes strap buckles or clamps for strongly securing attachment straps to a piling.

Yet another object of the present invention is to provide a portable piling extender apparatus that includes a piling extender portion and a piling-attached unit which are locked together.

Still a further object of the present invention is to provide a portable piling extender apparatus that has a generally linear horizontal cross-section for contacting a rubrail of a boat which also has a linear horizontal cross-section.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a portable piling extender apparatus embodying the principles and concepts of the present invention will be described.

Figure 1:
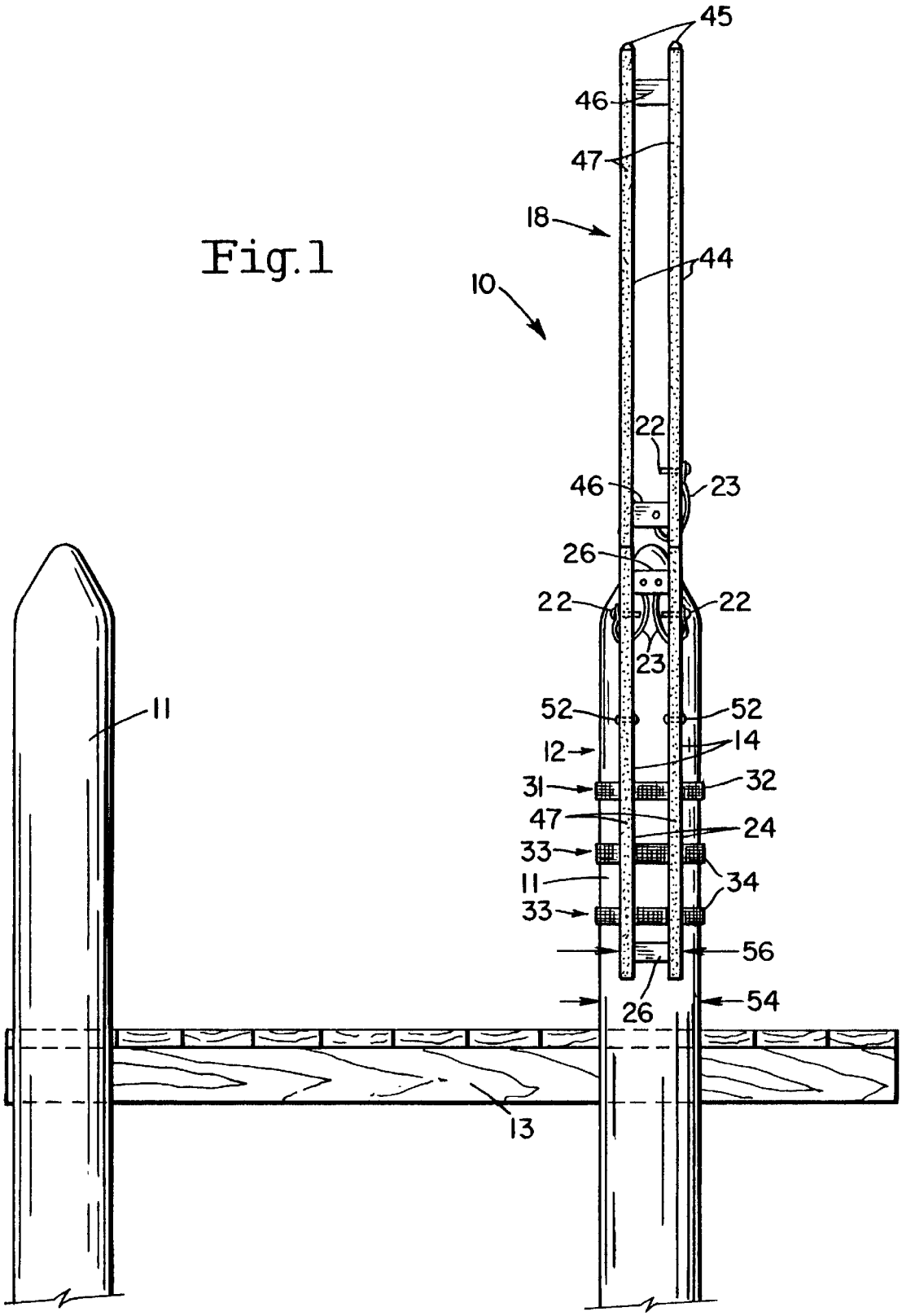
FIG. 1 a schematic front view of a preferred embodiment of a portable piling extender apparatus of the invention installed on a piling of a dock.
Figure 2:
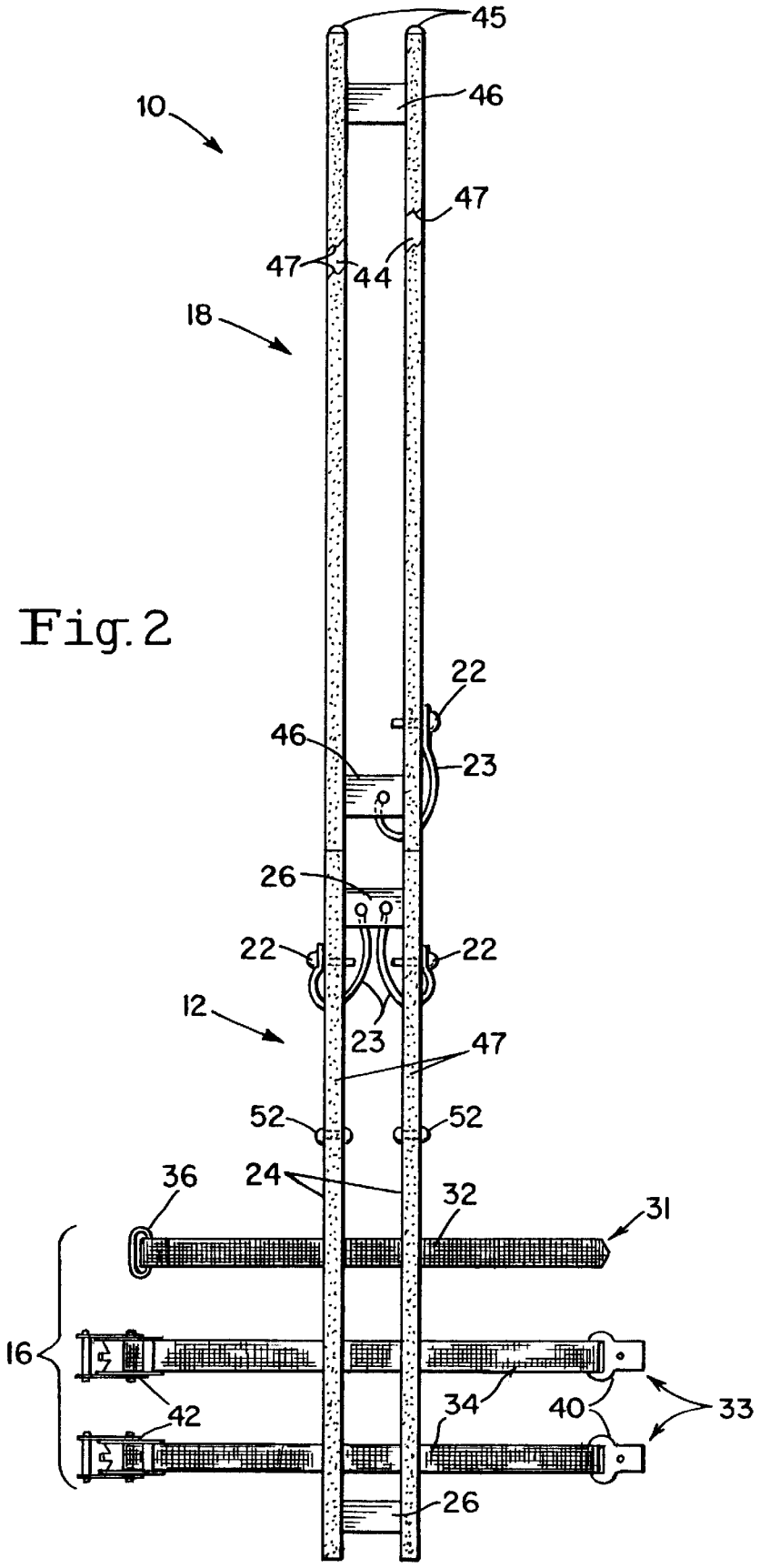
FIG. 2 is an enlarged front view of the embodiment of the invention shown in FIG. 1 removed from the piling.
Figure 3:
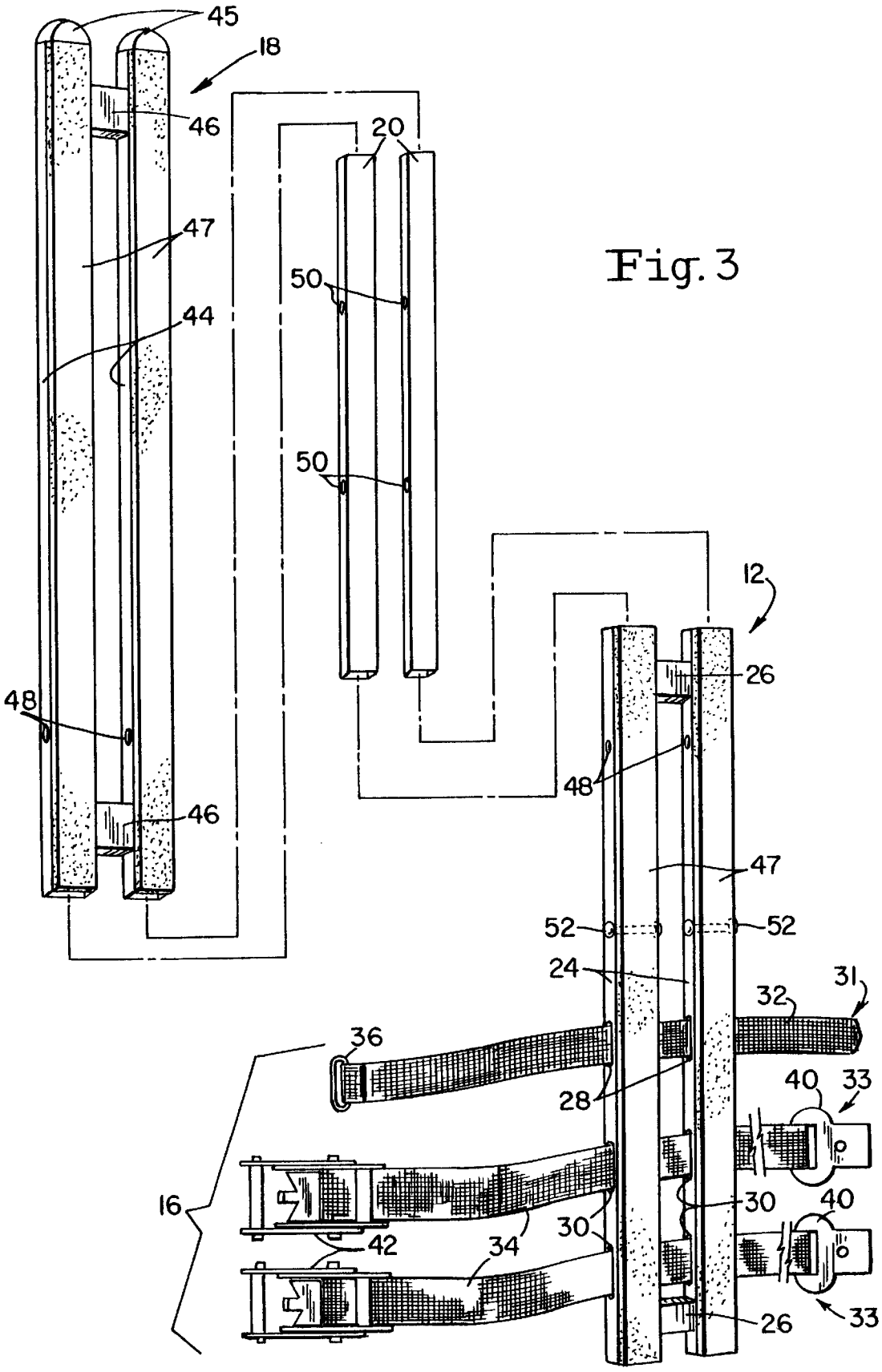
FIG. 3 is an exploded perspective view of the embodiment of the invention shown in FIGS. 1 and 2.

Turning to FIGS. 1–3, there is shown a preferred embodiment of the portable piling extender apparatus of the invention generally designated by reference numeral 10. In its preferred form, portable piling extender apparatus 10 includes a piling attachment unit 12 which includes a piling fence portion 14. A manually operable strap assembly 16 is connected to the piling fence portion 14. A riser fence unit 18 is provided, and alignment connectors 20 are provided for connecting the riser fence unit 18 to the piling fence portion 14. Alignment locks are provided for locking the riser fence unit 18 to the piling fence portion 14.

"As shown in FIG. 1, the piling 11 has a piling width 54, and the piling fence portion 14 has a piling fence portion width 56. As shown in FIG. 1, the piling fence portion width 56 is less than the piling width 54."

Preferbly, the piling fence portion 14 includes a pair of piling fence tubes 24, and a pair of first transverse struts 26 are connected between the piling fence tubes 24. The front faces of the piling fence tubes 24 are substantially coplanar.

The strap assembly 16 includes a first strap unit 31 and second strap units 33. The first strap unit 31 includes a first strap member 32, and a first strap lock 36 is connected to the first strap member 32. The first strap lock 36 can be comprised of hook-or-loop material, such as well known VELCRO(™) material. The second strap units 33 include second strap members 34, and second strap locks are connected to the second strap members 34. The second strap locks include strap tensioning ratcheted locks 42, and buckle ends 40 are received in the strap tensioning ratcheted locks 42.

The piling fence tubes 24 include first strap reception channels 28 and second strap reception channels 30. The first strap member 32 is threaded through the first strap reception channels 28, and second strap members 34 are threaded through the second strap reception channels 30.

The riser fence unit 18 includes riser fence tubes 44, and second transverse struts 46 are connected between the riser fence tubes 44. The front faces of the riser fence tubes 44 are substantially coplanar. In this respect, the front faces of the piling fence tubes 24 and the front faces of the riser fence tubes 44 are substantially coplanar when the riser fence tubes 44 are connected to the piling fence tubes 24. The front faces of the piling fence tubes 24 and the front faces of the riser fence tubes 44 further include fence cushions 47. The fence cushions 47 can be made from PVC tubing material that is cut in half longitudinally.

The riser fence unit 18 further includes riser tube caps 45 located on top of the riser fence tubes 44. The riser tube caps 45 have rounded tops. The riser tube caps 45 are made from cushiony material. The rounded-top riser tube caps 45 keep water out from the interiors of the riser fence tubes 44 and the piling fence tubes 24. The riser tube caps 45 can be made from rubber material and can cushion the impact of a boat hull if a boat rubrail rises above the riser tube caps 45. The riser fence tubes 44 are registrable with the piling fence tubes 24. The alignment connectors 20 can be in a form of connector tubes.

The alignment locks can include flexible tethers 23 connected to either the first transverse struts 26 or the second transverse struts 46. Lock pins 22 are connected to the flexible tethers 23. First pin reception channels 48 are located in the piling fence tubes 24 and the riser fence tubes 44, and second pin reception channels 50 are located in the connector tubes 20.

The piling fence tubes 24 include alignment connector tube stops 52 located inside the piling fence tubes 24. The alignment connector tube stops 52 can be comprised of ⅜ inch aluminum rod welded at outer portions of the piling fence tubes 24 across the respective interiors of the piling fence tubes 24.

As shown in the drawing figures, the alignment connectors 20 are located behind the front faces of the piling fence portion 14 and the riser fence unit 18. Also, as shown in the drawing figures, the lock pins 22 are located behind the front faces of the piling fence portion 14 and the riser fence unit 18.

The portable piling extender apparatus 10 of the invention can be used in the following way. A piling 11 is selected, and the piling attachment unit 12 is brought-to the piling 11. The rear faces of the piling fence tubes 24 are placed against the piling 11 so that the front faces of the piling fence tubes 24 face in the direction of the boat to be moored, which is in the direction away from the vertically extending piling. Also, the tops of the piling fence tubes 24 are placed at approximately the top of the piling 11. The first strap unit 31 is grasped the first strap member 32 is wrapped around the piling 11, and the VELCRO(™) first strap lock 36 is locked onto the first strap member 32, whereby the piling attachment unit 12 is attached to the piling 11.

Next, one of the second strap units 33 is grasped. A second strap member 34 is wrapped around the piling 11, and a buckle end 40 is connected to a strap tensioning ratcheted lock 42. Then, the strap tensioning ratcheted lock 42 is operated to firmly secure the piling attachment unit 12 onto the piling 11. To further increase the stability of the attachment of the piling attachment unit 12 to the piling 11, the additional one of the second strap units 33 is grasped. A second strap member 34 is wrapped around the piling 11, and a buckle end 40 is connected to a strap tensioning ratcheted lock 42. Then, the strap tensioning ratcheted lock 42 is operated to additionally firmly secure the piling attachment unit 12 onto the piling 11.

Then, first ends of the connector tubes 20 are placed inside the piling fence tubes 24 and moved down into the piling fence tubes 24 until stopped by the alignment connector tube stops 52. When this is done, the bottom two of the second pin reception channels 50 are in registration with the first pin reception channels 48 in the piling fence tubes 24. Then, to lock the connector tubes 20 to the piling fence tubes 24, lock pins 22 are inserted through the first pin reception channels 48 in the piling fence tubes 24 and the bottom second pin reception channels 50 in the connector tubes 20.

Then, the bottom ends of the riser fence tubes 44 are slid over the top ends of the connector tubes 20 so that the bottom ends of the riser fence tubes 44 are in contact with the top ends of the piling fence tubes 24. With the bottom ends of the riser fence tubes 44 in contact with the top ends of the piling fence tubes 24, the first pin reception channels 48 in the riser fence tubes 44 are in registration with the top second pin reception channels 50 in the connector tubes 20. Then, to lock the riser fence tubes 44 to the connector tubes 20, lock pins 22 are inserted through the first pin reception channels 48 in the riser fence tubes 44 and the top second pin reception channels 50 in the connector tubes 20. Once this is done, the portable piling extender apparatus 10 is fully mounted and assembled on the piling 11.

With the portable piling extender apparatus 10 mounted and assembled on the piling 11, when a boat is moored to the dock 13 near the portable piling extender apparatus 10, when the boat rises and falls in the water, the rubrail of the boat can bump up against and rub up against the fence cushions 47 on the piling fence tubes 24 and the riser fence tubes 44. In this way, the piling fence tubes 24, the riser fence tubes 44, and the fence cushions 47 keep the hull of the boat away from the piling 11 so that the hull of the boat is not damaged by contacting the piling 11.

The hull of a boat is especially protected from damage by the piling 11 when the hull of the boat rubs up against the fence cushions 47 and the riser fence tubes 44 which extend upward above the piling 11. If the riser fence tubes 44 were not present, when the boat rose sufficiently in the water, the rubrail of the boat would ride over the top of the piling 11, and the hull of the boat would be subject to damage by the top of the piling 11. However, with the portable piling extender apparatus 10 present on the piling 11, when the rubrail of the boat rides above the level of the piling 11, the rubrail of the boat then. rides up on the fence cushions 47 and the riser fence tubes 44. In this way, the hull of the boat is kept away from the piling 11 even though the rubrail of the boat is above the height of the piling 11.

Moreover, since the front faces of the piling fence tubes 24 and the front faces of the riser fence tubes 44 are substantially in a common plane, the substantially linear rubrail of the boat tends to be maintained in a substantially linear orientation with respect to the front faces of the piling fence tubes 24 and the riser fence tubes 44.

In addition, if the rubrail of the boat were to rise to such a height that it rides over the riser tube caps 45, then the riser tube caps 45 would cushion contact with the hull of the boat to prevent damage to the hull of the boat.

When the boat is to be released from being moored to the dock 13, the portable piling extender apparatus 10 of the invention can be removed from the piling 11 and disassembled so that the piling attachment unit 12, the connector tubes 20, and the riser fence unit 18 are not is connection to each other. These components can then be placed in a canvas carrying bag for storage and transportation until needed again. In the disassembled state, the piling extender apparatus 10 of the invention is very portable.

Although specific dimensions of components can be varied widely, and although the material from which components are fabricated can also be varied widely, the following dimensions and materials may are suitable for many applications. The piling attachment unit 12 and the riser fence unit 18 can be each approximately 3 feet long. The transverse distance between the piling fence tubes 24 can be approximately 7 inches. Similarly, the transverse distance between the riser fence tubes 44 can be approximately 7 inches. The connector tubes can be 2 feet long. The piling fence tubes 24 and the riser fence tubes 44 can be made from 2 inch diameter aluminum tubing. The first transverse struts 26 and the second transverse struts 46 can be made from aluminum plate.

The first strap unit 31 can include a first strap member 32 made from nylon and which includes VELCRO(™) material, which has dimensions 2 inches by 42 inches, and which has a stainless steel ring which also serves in locking the first strap member 32.

Each of the second strap units 33 can include a second strap member 34 made from PVC web or PVC impregnated nylon web 2 inches by 48 inches, can include a buckle end 40 which includes a flat hook, and can include a strap tensioning ratcheted lock 42 that is 2 inches, has a rating of 12,000 lb., and has a short wide handle. More specifically, the second strap units 33 can be made by Spanset Inc. USA, 3125 Industrial Drive, Sanford, N.C. 27330.

Although the alignment connectors for connecting the riser fence unit 18 to the piling attachment unit 12 have been disclosed above as being the connector tubes 20, along with the lock pins 22, other connectors for connecting the riser fence unit 18 to the piling attachment unit 12 are also contemplated. For example, with an alternate embodiment, the connectors can include the following. A hinge can be located between the bottom of the riser fence unit 18 and the top of the piling attachment unit 12. In a storage mode, the riser fence unit 18 and the piling attachment unit 12 are not in alignment. However in an in-use mode, the riser fence unit 18 is rotated around the hinge so that the riser fence unit 18 and the piling attachment unit 12 are in alignment. With this alternate embodiment, bolt-reception straps are fixed on the outside of the riser fence unit 18 and the piling attachment unit 12. When the riser fence unit 18 and the piling attachment unit 12 are in alignment, a lock bolt can be threaded through the bolt-reception straps to lock the riser fence unit 18 and the piling attachment unit 12 in the aligned orientation.

Generally, the components of the portable piling extender apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a portable piling extender apparatus that is low in cost, relatively simple in design and operation, and which may advantageously be used without driving poles into the earth under a body of water. With the invention, a portable piling extender apparatus is provided which can be carried along in a boat so that the apparatus is readily available each time the boat is ready to dock. With the invention, a sortable piling extender apparatus is provided which does not use a sleeve that rides up and down on a cable. With the invention, a portable piling extender apparatus is provided which does not employ a carriage which has internal moving parts.

With the invention, a portable piling extender apparatus is provided which is easily attached to and removed from a piling. With the invention, a portable piling extender apparatus is provided which includes strap buckles or clamps for strongly securing attachment straps to a piling. With the invention, a portable piling extender apparatus is provided which includes a piling extender portion and a piling-attached unit which are locked together. With the invention, a portable piling extender apparatus is provided which has a generally linear horizontal cross-section for contacting a rubrail of a boat which also has a linear horizontal cross-section.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the united states is as follows:

1. A portable piling extender apparatus attached to a vertically extending piling, comprising:

a piling attachment unit which includes a piling fence portion and a manually operable strap assembly connected to said piling fence portion, said strap assembly attaching said piling fence portion to the vertically extending piling, a riser fence unit, alignment connectors for connecting said riser fence unit to said piling fence portion in an aligned orientation, such that portions of said alignment connectors and said riser fence unit extend vertically above the top of the vertically extending piling, and alignment locks connected to said piling fence portion and said riser fence unit for locking said riser fence unit to said piling fence portion.

2. The apparatus of claim 1 wherein said piling fence portion includes:

a pair of piling fence tubes, and a pair of first transverse struts connected between said piling fence tubes.

3. The apparatus of claim 2 wherein said piling fence tubes include alignment connector stops located inside said piling fence tubes.

4. The apparatus of claim 2 wherein front faces of said piling fence tubes are substantially coplanar.

5. The apparatus of claim 1 wherein said strap assembly includes a first strap unit and second strap units.

6. The apparatus of claim 5 wherein:

said first strap unit includes a first strap member and a first strap lock connected to said first strap member, and said second strap units include second strap members and second strap locks connected to said second strap members.

7. The apparatus of claim 6 wherein said second strap locks include:

strap tensioning ratcheted locks and buckle ends received in said strap tensioning ratcheted locks.

8. The apparatus of claim 6 wherein:

said piling fence portion includes piling fence tubes and said piling fence tubes include first strap reception channels and second strap reception channels, said first strap member is threaded through said first strap reception channels, and second strap members are threaded through said second strap reception channels.

9. The apparatus of claim 1 wherein said riser fence unit includes:

riser fence tubes, and second transverse struts connected between said riser fence tubes.

10. The apparatus of claim 9 wherein front faces of said riser fence tubes are substantially coplanar.

11. The apparatus of claim 9 wherein said piling attachment unit includes piling fence tubes and wherein front faces of said piling fence tubes and said front faces of said riser fence tubes are substantially coplanar when said riser fence tubes are connected to said piling fence tubes.

12. The apparatus of claim 11 wherein said front faces of said piling fence tubes and said front faces of said riser fence tubes further include fence cushions.

13. The apparatus of claim 9 wherein said riser fence unit further includes riser tube caps located on top of said riser fence tubes.

14. The apparatus of claim 13 wherein said riser tube caps have rounded tops.

15. The apparatus of claim 13 wherein said riser tube caps are made from cushiony material.

16. The apparatus of claim 9 wherein said piling fence portion includes piling fence tubes, and wherein riser fence tubes are registrable with said piling fence tubes.

17. The apparatus of claim 1 wherein said piling fence portion includes piling fence tubes and first transverse struts connected between said piling fence tubes, wherein said riser fence unit includes riser fence tubes and second transverse struts connected between said riser fence tubes, and wherein said alignment locks include:

flexible tethers connected to either said first transverse struts or said second transverse struts, lock pins connected to said flexible tethers, first pin reception channels located in said piling fence tubes and said riser fence tubes, and second pin reception channels located in said alignment connectors.

18. The apparatus of claim 1 wherein said alignment connectors are in a form of connector tubes.

19. The apparatus of claim 1 wherein front faces of the piling fence portion and front faces of the riser fence unit are substantially coplanar when said riser fence unit is connected to said pilings fence portion.

20. A method for preventing a boat from being damaged by a piling during times of rising and falling water, comprising the steps of:

attaching a piling attachment unit to the piling, placing ends of alignment connectors into the piling attachment unit, wherein the alignment connectors extend vertically upward above the piling attachment unit and the piling, locking the alignment connectors to the piling attachment unit, attaching a riser fence unit to the alignment connectors, whereby a portion of the riser fence unit extends vertically upward above the alignment connectors, the piling attachment unit, and the piling, locking the riser fence unit to the piling attachment unit, and permitting the boat to contact front surfaces of the piling attachment unit and the riser fence unit during rising and falling water.

21. The method of claim 20 wherein front faces of the piling attachment unit and the riser fence unit are coplanar.

22. A portable piling extender apparatus attached to a vertically extending piling that has a piling width, comprising:

a piling attachment unit which includes a piling fence portion and a manually operable strap assembly connected to said piling fence portion, wherein said piling fence portion has a piling fence portion width, and wherein said piling fence portion width is less than the piling width, wherein said manually operable strap a assembly attaches said piling fence portion to the piling, and wherein rear faces of said piling fence portion are placed against the piling so that front faces of said piling fence portion face in a direction away from the vertically extending piling, a riser fence unit, alignment connectors for connecting said riser fence unit to said piling fence portion in an aligned orientation, such that portions of said alignment connectors and portions of said riser fence unit extend upward above the piling when said alignment connectors and said riser fence unit are connected to said piling fence portion, and alignment locks connected to said piling fence portion for locking said piling fence portion to said alignment connectors, and alignment locks connected to said riser fence unit for locking said riser fence unit to said alignment connectors, whereby said piling fence portion is locked to said riser fence unit by said alignment locks.

23. A portable piling extender apparatus, comprising:

a vertically extending piling, a piling attachment unit which includes a piling fence portion and a manually operable strap assembly connected to said piling fence portion, wherein said piling attachment unit is. connected to said vertically extending piling, and wherein rear faces of said piling fence portion are placed against said vertically extending piling so that front faces of said piling fence portion face in a direction away from said vertically extending piling, a riser fence unit, alignment connectors for connecting said riser fence, unit to said piling fence portion in an aligned orientation, such that said riser fence unit extends vertically above said vertically extending piling when said riser fence unit is connected to said piling fence portion, wherein said alignment connectors are located behind the front faces of said piling fence portion and said riser fence unit, and alignment locks connected to said piling fence portion for locking said piling fence portion to said alignment connectors, and alignment locks connected to said riser fence unit for locking said riser fence unit to said alignment connectors, whereby said piling fence portion is locked to said riser fence unit by said alignment locks, with said riser fence unit extending vertically above said vertically extending piling, wherein said alignment locks are located behind the front faces of said piling fence portion and said riser fence unit.

24. A portable piling extender apparatus, comprising:

a vertically extending piling, a piling attachment unit which includes a piling fence portion and a manually operable strap assembly connected to said piling fence portion, wherein said piling attachment unit is connected to said vertically extending piling, and wherein rear faces of said piling fence portion are placed against said vertically extending piling so that front faces of said piling fence portion face in a direction away from said vertically extending piling, a riser fence unit, alignment connectors for connecting said riser fence unit to said piling fence portion in an aligned orientation, such that said riser fence unit extends vertically above said vertically extending piling when said riser fence unit is connected to said piling fence portion, and such that said alignment connectors are located behinds aid front faces of said piling fence portion and said riser fence unit, and alignment locks connected to said piling fence portion and said riser fence unit behind said front faces of said piling fence portion and behind said front faces of said riser fence unit for locking said riser fence unit to said piling fence portion, with said riser fence unit extending vertically above said vertically extending piling.

* * * * *